US007857486B2

(12) United States Patent
Long et al.

(10) Patent No.: US 7,857,486 B2
(45) Date of Patent: Dec. 28, 2010

(54) LED LAMP ASSEMBLY HAVING HEAT PIPES AND FINNED HEAT SINKS

(75) Inventors: Bin Long, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 162 days.

(21) Appl. No.: 12/134,159

(22) Filed: Jun. 5, 2008

(65) Prior Publication Data

US 2009/0303717 A1 Dec. 10, 2009

(51) Int. Cl.
*F21V 29/00* (2006.01)

(52) U.S. Cl. ..... 362/294; 362/249.02; 362/218; 362/373

(58) Field of Classification Search ..... 362/294, 362/373, 547, 249.02, 218
See application file for complete search history.

(56) References Cited

U.S. PATENT DOCUMENTS 6,517,221 B1 * 2/2003 Xie ..... 362/373
6,831,303 B2 * 12/2004 Dry ..... 257/88
2006/0245162 A1 * 11/2006 Lee et al. ..... 361/701
2008/0007954 A1 * 1/2008 Li ..... 362/294
2008/0007955 A1 * 1/2008 Li ..... 362/294
2009/0040759 A1 * 2/2009 Zhang et al. ..... 362/249
2009/0095448 A1 * 4/2009 Lai et al. ..... 165/104.33

FOREIGN PATENT DOCUMENTS

CN 1825648 A 8/2006
CN 2934915 Y 8/2007
CN 2934916 Y 8/2007

* cited by examiner

*Primary Examiner*—Thomas M Sember
(74) *Attorney, Agent, or Firm*—Frank R. Niranjan

(57) ABSTRACT

An LED lamp assembly includes a first heat sink, a plurality of second heat sinks secured to a periphery of the first heat sink, a plurality of LED modules respectively attached to the second heat sinks and a plurality of heat pipes interconnecting the first heat sink and the second heat sinks. The first heat sink comprises a heat conducting body defining a through hole therein and a plurality of first fins around the heat conducting body. The second heat sinks each comprise a plurality of second fins facing the first fins of the first heat sink. The heat pipes each comprise an evaporating section attached to a corresponding second heat sink and a condensing section extending into the through hole of the heat conducting body of the first heat sink and attached to the heat conducting body.

12 Claims, 5 Drawing Sheets

LED LAMP ASSEMBLY HAVING HEAT PIPES AND FINNED HEAT SINKS

BACKGROUND OF THE INVENTION

1. Field of the Invention

The present invention relates to an LED lamp assembly for a lighting purpose, and more particularly relates to an improved LED lamp assembly having a good heat dissipation capability and large illumination area.

2. Description of Related Art

An LED lamp assembly is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp assembly is intended to be a cost-effective yet high quality replacement for incandescent and fluorescent lamps.

Known implementations of LED modules in an LED lamp assembly make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp assembly reliability.

Besides, since the LEDs are generally arranged on a printed circuit board which has a flattened surface, the LEDs acting as a light source and arranged in this way usually are failed to provide a three-dimensional lamplight for a condition that needs even and large-scale light.

What is needed, therefore, is an improved LED lamp assembly which can overcome the above problems.

SUMMARY OF THE INVENTION

An LED lamp assembly includes a first heat sink, a plurality of second heat sinks secured to a periphery of the first heat sink, a plurality of LED modules respectively attached to the second heat sinks and a plurality of heat pipes interconnecting the first heat sink and the second heat sinks. The first heat sink comprises a heat conducting body defining a through hole therein and a plurality of first fins around the heat conducting body. The second heat sinks each comprise a plurality of second fins facing the first fins of the first heat sink. The heat pipes each comprise an evaporating section attached to a corresponding second heat sink and a condensing section extending into the through hole of the heat conducting body of the first heat sink and attached to the heat conducting body. The LED modules face outward toward different radial directions of the first heat sink, whereby the LED lamp assembly can cover a large range of illumination. Heat generated by the LED modules is dissipated by the second heat sinks directly and the first heat sink via the heat pipes.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
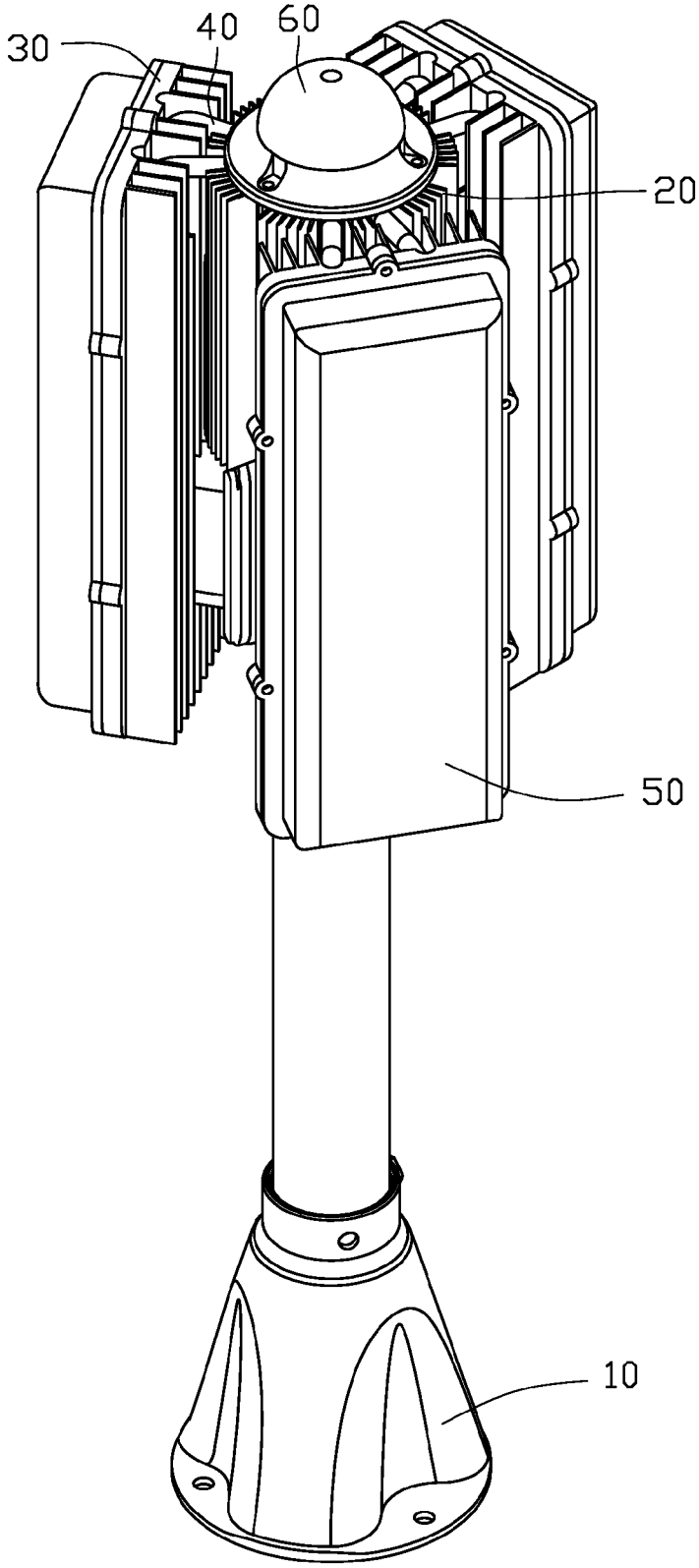
FIG. 1 is an isometric, assembled view of an LED lamp assembly in accordance with a preferred embodiment of the present invention.
Figure 2:
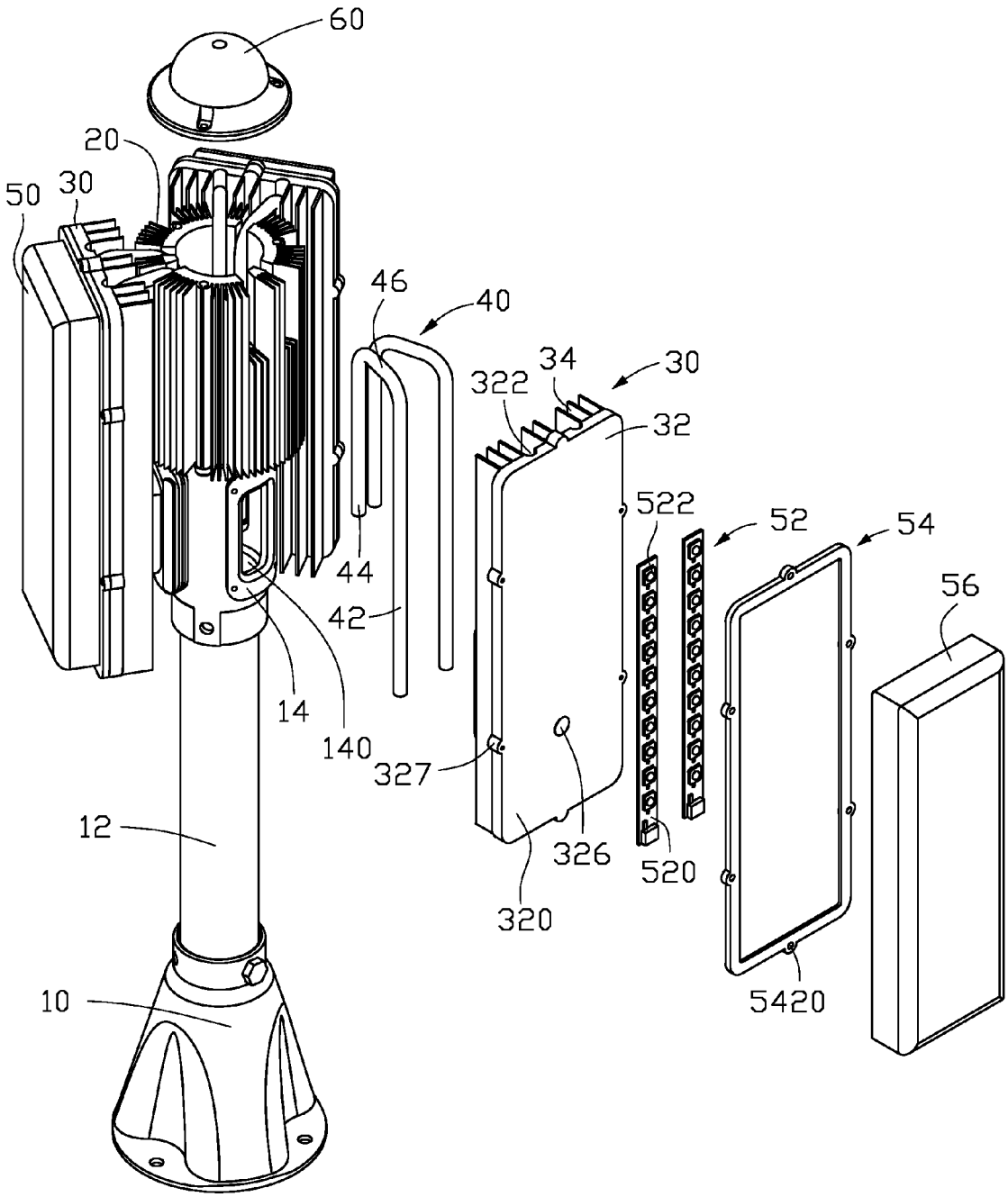
FIG. 2 is an partially exploded view of FIG. 1.

Referring to FIGS. 1-2, an LED lamp assembly for a lighting purpose in accordance with a preferred embodiment of the present invention is shown. The LED lamp assembly comprises a first heat sink 20, three second heat sinks 30 located around a periphery of the first heat sink 20, three LED modules 50 respectively thermally attached to outer sidewalls of the second heat sinks 30 and three groups of heat pipes 40 connecting the second heat sinks 30 with the first heat sink 20.

The LED lamp assembly further comprises a top cover 60 covering a top of the first heat sink 20. The LED lamp assembly can be held at a predetermined position by a supporting post 10 engaging with the first heat sink 20. In this embodiment, the supporting post 10 extends upwardly to support the first heat sink 20 on a top thereof. The supporting post 10 comprises a cylindrical lamp holder 12, which supports the first heat sink 20 on a top thereof. The lamp holder 12 has three engaging portions 14 extending outwardly along a circumferential sidewall thereof. The engaging portions 14 are evenly located around the circumferential sidewall of the lamp holder 12 of the supporting post 10 and each are provided with a locking hole 140 therein.

Figure 3:
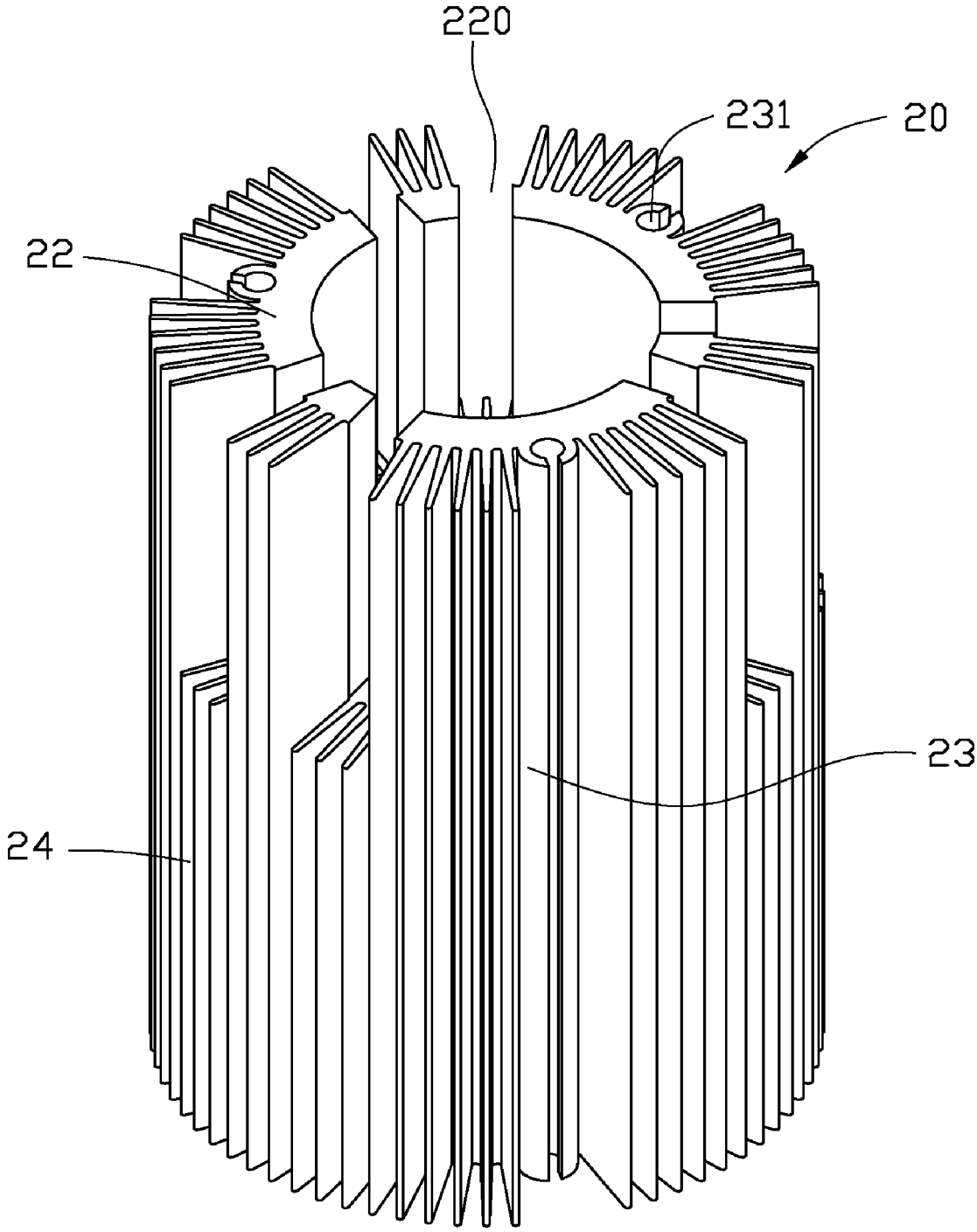
FIG. 3 is an enlarged view of a first heat sink of the LED lamp assembly of FIG. 1.
Figure 4:
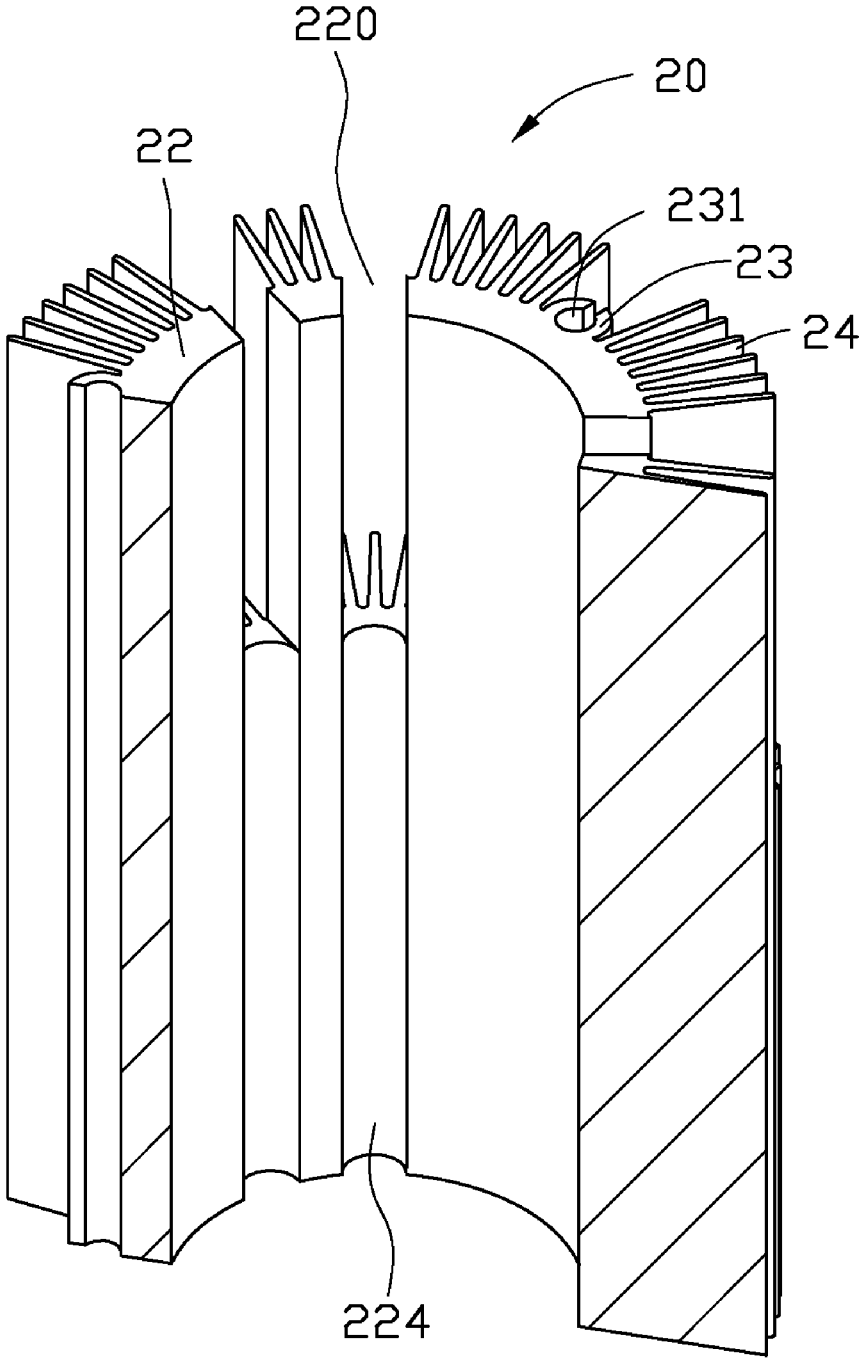
FIG. 4 is a view similar to FIG. 3, with a part of the first heat sink being cut away for clarity.

As shown in FIGS. 3-4, the first heat sink 20 is integrally formed of a one-piece metal with good heat conductivity, such as aluminum or copper. The first heat sink 20 increases a heat dissipating area of the LED lamp assembly. The first heat sink 20 comprises an elongated cylindrical heat conducting body 22 with a through hole (not labeled) defined therein. A plurality of first fins 24 is extended radially and outwardly from a circumferential sidewall of the heat conducting body 22. Three elongated ridges 23 extend outwardly from an outer sidewall of the heat conducting body 22 of the first heat sink 20 along a top-bottom direction of the heat conducting body 22. The elongated ridges 23 are symmetrically defined around the circumferential sidewall of the heat conducting body 22 of the first heat sink 20 and parallel to a central axis of the heat conducting body 22 of the first heat sink 20. Each of the ridges 23 defines a mounting hole 231 therein, aligned with a screw hole (not labeled) defined in the top cover 60 and an engaging orifice (not shown) defined in a top portion of the lamp holder 12 of the supporting post 10. Screws (not shown) can be used to extend through the screw holes of the top cover 60 and the mounting holes 231 of the ridges 23 and threadedly engage in the engaging orifices (not shown) of the lamp holder 12 of the supporting post 10 to secure the top cover 60 to a top of the first heat sink 20 and the first heat sink 20 to the top portion of the lamp holder 12 of the supporting post 10, whereby the first heat sink 20 can be securely mounted on the top portion of the lamp holder 12 of the supporting post 10. Three groups of channels 220 are defined in a top portion of the heat conducting body 22 along a top-bottom direction of the heat conducting body 22. The three groups of channels 220 are symmetrically defined in a circumferential direction of the heat conducting body 22 and parallel to the central axis of the heat conducting body 22. Each group of the channels 220 has two channels 220 parallel and adjacent to each other, for the heat pipes 40 extending therethrough. The channels 220 are formed by removing parts of an upper portion of the first fins 24 and the heat conducting body 22 of the first heat sink 20 along the top-bottom direction of the first heat sink 20. Corresponding to the channels 220, three groups of slots 224 are defined in an inner sidewall of the heat conducting body 22 of the first heat sink 20 along a direction parallel to the central axis of the heat conducting body 22 of the first heat sink 20. The slots 224 and the corresponding channels 220 cooperate to define a space for accommodating the corresponding heat pipes 40 therein.

Figure 5:
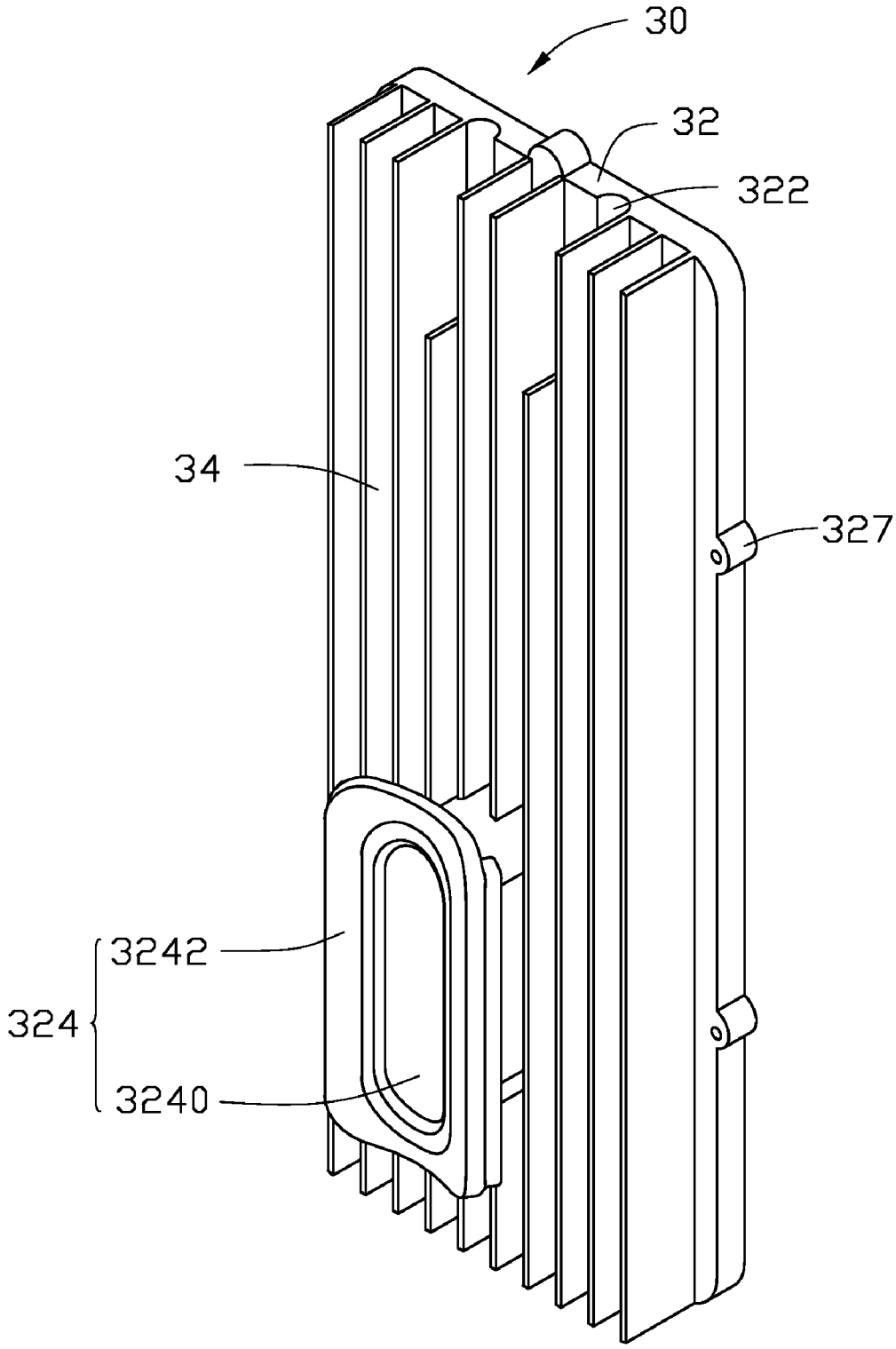
FIG. 5 is an enlarged view of a second heat sink of the LED lamp assembly of FIG. 1, but seen from a different aspect.

As shown in FIG. 2 and FIG. 5, each second heat sink 30 is also integrally formed of a one-piece metal with good heat conductivity, such as aluminum or copper. The second heat sink 30 comprises a rectangular heat conducting plate 32. A plurality of second fins 34 is extended outwardly from an outer side of the heat conducting plate 32. A pair of grooves 322 is defined in the outer side of the heat conducting plate 32 and parallel to each other for receiving the heat pipes 40 therein. An annular fixing part 324 extends outwardly and vertically from the outer side of the heat conducting plate 32 of the second heat sink 30 for engaging with the engaging portion 14 of the lamp holder 12 of the supporting post 10 to mount the second heat sink 30 on the lamp holder 12 of the supporting post 10. The corresponding fixing part 324 can be locked together with the engaging portion 14 of the supporting post 10 by means of screws passing through the fixing part 324 and screwing into the engaging portion 14. Each fixing part 324 and a corresponding engaging portion 14 cooperatively form an enclosure (not labeled) defining an inner space therein. A rectifier (not shown) for the LED modules 50 can be accommodated in the inner space of the enclosure. The fixing part 324 is located above the second fins 34 of the heat conducting plate 32 for conveniently connecting the fixing part 324 and the engaging portion 14 together. The fixing part 324 comprises an annular sleeve 3240 extending outwardly and vertically from the outer side of the heat conducting plate 32 and a flange 3242 extending outwardly from a circumference of the sleeve 3240. The flange 3242 is arced upwardly along an outward direction. The flange 3242 is provided for engaging with a corresponding engaging portion 14 of the lamp holder 12 of the supporting post 10. Corresponding to the fixing part 324, a through hole 326 is defined in a middle of a lower portion of the heat conducting plate 32 and communicates with the sleeve 3240, for allowing lead wires (not shown) electrically connecting with the LED modules 50 to extend through the fixing part 324 and be received in the inner space (not labeled) defined by the fixing part 324 and the engaging portion 14. A plurality of fixing ears 327 is formed from a circumferential sidewall of the heat conducting plate 32 of the second heat sink 30. Each fixing ear 327 defines a fixing hole (not labeled) therein for allowing a plurality of bolts (not shown) inserted therein to securely lock the LED module 50 to another outer side 320 of the heat conducting plate 32 of the second heat sink 30.

Each group of the heat pipes 40 has two heat pipes 40 and each heat pipe 40 comprises an evaporating section 42, a condensing section 44 parallel to the evaporating section 42 and a connecting section 46 interconnecting the evaporating section 42 and the condensing section 44. The evaporating section 42 has a length longer than that of the condensing section 44. The three groups of the heat pipes 40 are evenly fixed to the first heat sink 20 along the circumferential direction of the heat conducting body 22 of the first heat sink 20 by soldering, wherein each of the evaporating sections 42 of the heat pipes 40 is accommodated in the groove 322 of the heat conducting plate 32 of the second heat sink 30, each of the connecting sections 46 of the heat pipes 40 is located adjacent to a top face of the heat conducting body 22 of the first heat sink 20 (illustrated in FIG. 2), and each of the condensing sections 44 of the heat pipes 40 is spaced a distance from the heat conducting plate 32 of the second heat sink 30, whereby the condensing sections 44 of the heat pipes 40 are received in the channels 220 and the slots 224 of the heat conducting body 22 of the first heat sink 20.

The LED modules 50 are attached to the another outer sides 320 of the heat conducting plates 32 of the second heat sinks 30, respectively. Each of the LED modules 50 comprises two LED assemblies 52, a frame 54 and a cover 56. Each LED assembly 52 has a rectangular printed circuit board 520 and a plurality of LEDs 522 arranged on a side along an elongated direction of the printed circuit board 520. The LED assembly 52 is attached to the corresponding another outer side 320 of the heat conducting plate 32 of the second heat sink 30 along the axis of the first heat sink 20 with an opposite side of the printed circuit board 520 of the LED assembly 52 contacting the corresponding another outer side 320 of the heat conducting plate 32 of the second heat sink 30. The printed circuit boards 520 of the LED assemblies 52 are located corresponding to the grooves 322 of the heat conducting plate 32 of the second heat sink 30 for ensuring that heat generated by the LEDs 522 can be quickly conducted to the evaporating sections 42 of the heat pipes 40 received in the grooves 322.

The frame 54 has a rectangular, ring-like shape and includes a plurality of through orifices 5420 located corresponding to the fixing holes (not labeled) of the fixing ears 327 of the second heat sink 30. The cover 56 is made of transparent/translucent plastic or glass and in the form of a rectangular hood. The cover 56 is mounted in the frame 54. Screws (not shown) are used to extend through the through orifices 5420 of the frame 54 to screw into the locking holes of the fixing ears 327 of the second heat sink 30 to thereby secure the cover 56 to the another outer side 320 of the heat conducting plate 32 of the second heat sink 30.

In use of the LED lamp assembly, the three second heat sinks 30 are assembled to the circumference of the first heat sink 20 by the three groups of the heat pipes 40 being respectively connected with the second heat sinks 30 and the first heat sink 20. The LED modules 50 are attached to the another outer sides 320 of the second heat sinks 30. At this embodiment, the LED assemblies 52 face outwardly from the first heat sink 20 along three equidistantly, radially outward directions. As the LED assemblies 52 are disposed surrounding the first heat sink 20, every sides of the LED lamp assembly are sufficiently illuminated, whereby the LED lamp assembly can provide a large illumination area. When the LEDs 522 of the LED assemblies 52 are activated to lighten, the heat generated from the LEDs 522 is conducted to the heat conducting plates 32 of the second heat sinks 30 via the printed circuit boards 520 of the LED assemblies 52. Since the heat pipes 40 connect the second heat sinks 30 and the first heat sink 20, the heat can be not only dissipated by the second heat sinks 30, but also dissipated by the first heat sink 20. A part of the heat is dispersed to the ambient cool air via the second fins 34 of the second heat sinks 30. Remaining part of the heat is transmitted to the first heat sink 20 via the heat pipes 40, whereby the heat which originally should be concentrated in the second heat sink 30 is partly transferred to the first heat sink 20 and is dispersed to surrounding environment by cool air which flows through the first fins 24 of the first heat sink 20.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly, comprising:

a first heat sink having a heat conducting body defining a through hole therein and a plurality of first fins around the heat conducting body;

a plurality of second heat sinks being secured to a periphery of the first heat sink;

a plurality of heat pipes each comprising an evaporating section attached to a corresponding second heat sink and a condensing section extending into the through hole of the heat conducting body of the first heat sink and attached to the heat conducting body; and a plurality of LED modules respectively attached to the second heat sinks;

wherein each of the second heat sinks comprises a plurality of second fins facing the first fins of the first heat sink;

wherein the second heat sinks are spaced from each other;

wherein the evaporating sections of the heat pipes are received in grooves defined in the second heat sinks; and wherein the condensing sections of the heat pipes are fixed to the heat conducting body of the first heat sink along a circumferential direction of the first heat sink.

2. The LED lamp assembly as claimed in claim 1, wherein the second heat sinks are located parallel to a central axis of the first heat sink.

3. The LED lamp assembly as claimed in claim 2, wherein the heat conducting body of the first heat sink comprises a plurality of elongated ridges extend outwardly from an outer sidewall of the heat conducting body of the first heat sink along a top-bottom direction of the heat conducting body, adapted for extension of screws therein.

4. The LED lamp assembly as claimed in claim 3, wherein the condensing section of each heat pipe has a length longer than that of the evaporating section.

5. The LED lamp assembly as claimed in claim 3, wherein each second heat sink further comprises a heat conducting plate, the plurality of second fins extending from the heat conducting plate toward the first heat sink, each of the LED modules being attached to an outer surface of the heat conducting plate of a corresponding one of the second heat sinks.

6. The LED lamp assembly as claimed in claim 1, wherein the heat conducting body of the first heat sink defines a plurality of slots in an inner sidewall thereof, the condensing sections of the heat pipes being received in the slots, respectively.

7. The LED lamp assembly as claimed in claim 6, wherein the heat conducting body of the first heat sink further defines a plurality of channels corresponding to the slots and the corresponding channel and slot cooperate to form a space for accommodating the condensing section of a corresponding heat pipe therein.

8. An LED lamp comprising:

a supporting post comprising a plurality of engaging portions extending radially and outwardly from a circumferential sidewall thereof along different directions;

a first heat sink having a heat conducting body mounted on a top of the supporting post and a plurality of first fins around the heat conducting body;

a plurality of second heat sinks being secured to the engaging portions, respectively, and located at a periphery of the first heat sink;

a plurality of LED modules mounted on outer sides of the second heat sinks and thermally connecting therewith; and a plurality of heat pipes connecting the second heat sinks and the first heat sink, the heat pipes being attached to inner sides of the second heat sinks and extending into the first heat sink;

wherein each of the second heat sinks comprises a plurality of second fins facing the first fins of the first heat sink, and the second fins are spaced from the first fins in a radial direction.

9. The LED lamp as claimed in claim 8, wherein each second heat sink has a fixing part extending from the each second heat sink toward a corresponding engaging portion of the supporting post, the fixing part of the each second heat sink being surrounded by the second fins and being engaged with the corresponding engaging portion of the supporting post to secure the each second heat sink to the supporting post.

10. The LED lamp as claimed in claim 9, wherein the fixing part comprises an annular sleeve extending outwardly and vertically from the each second heat sink toward the corresponding engaging portion and a ring-shaped flange extending outwardly from a circumferential rim of the sleeve, the flange being engaged with the corresponding engaging portion of the supporting post.

11. The LED lamp as claimed in claim 10, wherein the each second heat sink defines a bore communicating with the fixing part, adapted for allowing lead wires electrically connecting with a corresponding LED module to extend through the fixing part and be received in an inner space defined by the fixing part and the corresponding engaging portion of the supporting post.

12. An LED lamp comprising:

a supporting post comprising a plurality of engaging portions extending radially and outwardly from a circumferential sidewall thereof along different directions;

a first heat sink having a heat conducting body mounted on a top of the supporting post and a plurality of first fins around the heat conducting body and above the engaging portions of the supporting post;

a plurality of second heat sinks being secured to the engaging portions, respectively, and located at a periphery of the first heat sink;

a plurality of LED modules mounted on outer sides of the second heat sinks and thermally connecting therewith; and a plurality of heat pipes connecting the second heat sinks and the first heat sink;

wherein each second heat sink comprises a heat conducting plate and a plurality of second fins extending from the heat conducting plate toward the first fins of the first heat sink, and a fixing part extending from the heat conducting plate of the each second heat sink toward a corresponding engaging portion of the supporting post to a place beyond the second fins, the fixing part of the each second heat sink being engaged with the corresponding engaging portion of the supporting post to secure the each second heat sink to the supporting post.

* * * * *